United States Patent [19]

Appleton et al.

[11] 4,275,520

[45] Jun. 30, 1981

[54] MODULAR PLANE SURFACE DISPLAY STRUCTURE

[75] Inventors: Harold L. Appleton, Needham; Douglas R. Kingston, Norwood, both of Mass.

[73] Assignee: Appleton-Kingston, Inc., Needham, Mass.

[21] Appl. No.: 40,111

[22] Filed: May 18, 1979

[51] Int. Cl.[3] ..... G09F 7/02; G09F 7/20

[52] U.S. Cl. ..... 40/605; 40/155; 52/582; 52/DIG. 13

[58] Field of Search ..... 40/605, 606, 607, 610, 40/155, 152.1, 152, 156, 624, 617; 52/592, 593, 594, 581, 582, DIG. 13, 574, 578

[56] References Cited

U.S. PATENT DOCUMENTS

| | | | |
|---|---|---|---|
| 3,571,999 | 3/1971 | Downing | 40/605 X |
| 3,642,144 | 2/1972 | Brooks | 40/605 |
| 3,721,050 | 3/1973 | Perina | 52/DIG. 13 |
| 3,777,431 | 12/1973 | Bowman | 52/574 |
| 3,863,412 | 2/1975 | Bodycomb et al. | 52/DIG. 13 |
| 3,866,379 | 2/1975 | Paulke | 52/593 |
| 3,935,656 | 2/1976 | Pritchard | 40/155 |
| 4,001,987 | 1/1977 | Coulthard | 160/135 X |
| 4,030,219 | 6/1977 | Donovan | 40/605 X |
| 4,118,903 | 10/1978 | Coulthard | 52/DIG. 13 |

*Primary Examiner*—John F. Pitrelli

[57] ABSTRACT

A modular panel system for making possible easy transportation in compact dissassembled form of a large single plane display surface structure comprised of at least four plastic foam core type panel sections assembled with their edges abutting the edges of adjacent panel sections so that the front faces of the panel sections form the single plane display surface and the back face of each of the abutting panel sections has fastened thereto at support positions with separable and pressure engageable loop and hook fastener elements a support panel overlapping the abutting edges of the associated panel sections so as to firmly bind the associated panel sections and support panel together, and a periphery support member at each of the peripheral edge junctures of the panel sections and likewise having separable and pressure engageable loop and hook elements binding the peripheral edges of the panel sections and the periphery support members together to thereby provide a unitary single plane display structure which has capacity to be readily dissassembled for compact storage or for easy transportation.

8 Claims, 9 Drawing Figures

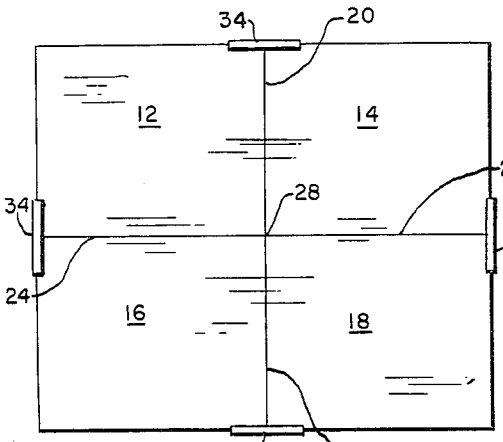
Fig. 1.
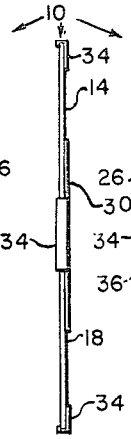
Fig. 2.
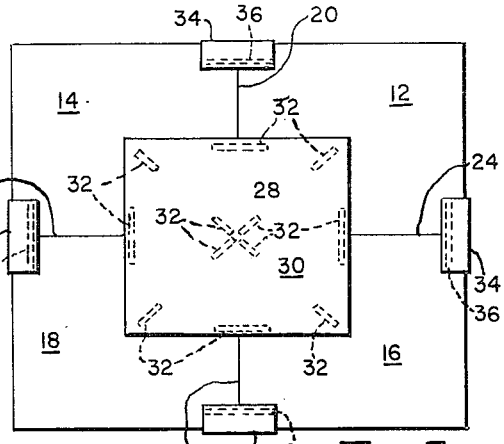
Fig. 3.
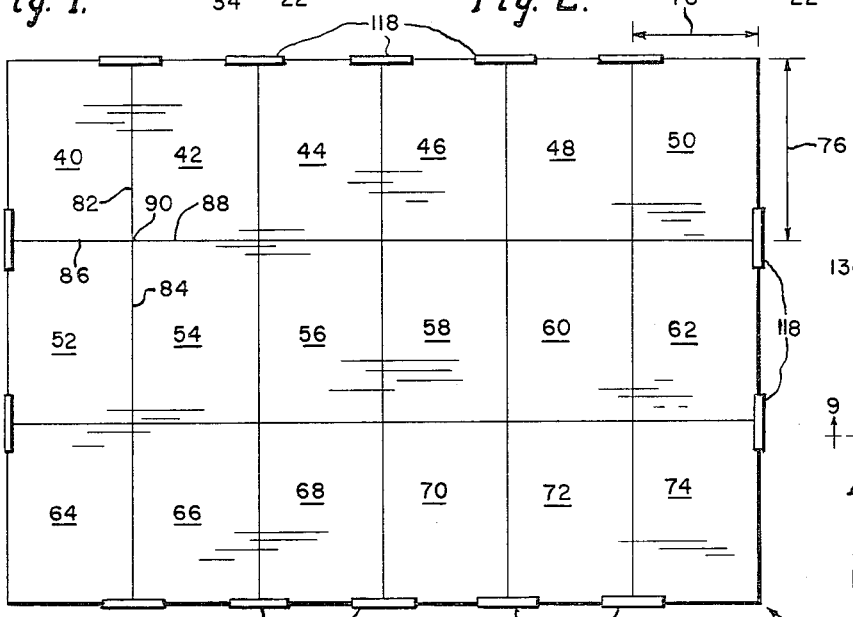
Fig. 4.
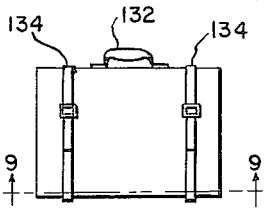
Fig. 8.
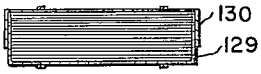
Fig. 9.
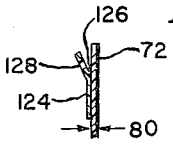
Fig. 7.
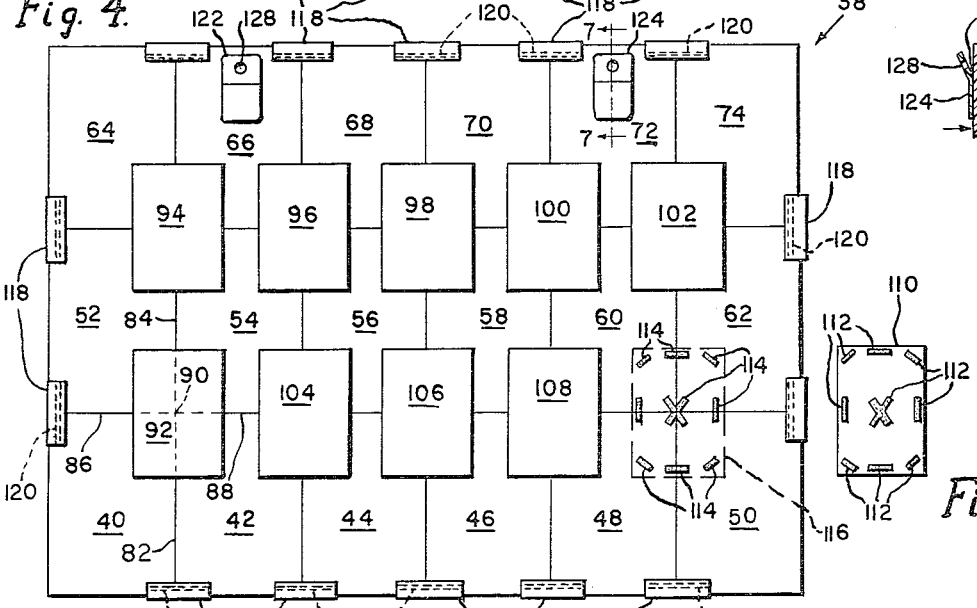
Fig. 5.
Fig. 6.

MODULAR PLANE SURFACE DISPLAY STRUCTURE

BACKGROUND OF THE INVENTION (1) Field of the Invention

Modular panel display system for making possible easy transportation in compact dissassembled form of a large single plane display surface structure of at least four panel sections assembled with their edges abutting each other.

(2) Description of the Prior Art

For promotional display of products such as at sales conventions, it often becomes desirable to have large pictorial panels forming the walls of a display booth or hanging at suitable locations and carrying sales information for prospective customers. Such panels must generally be prepared by professional commercial artists or photographers and because of their large size and bulk become relatively cumbersome and expensive to transport to distant cities where the promotions occur.

There have been invented in the past some knockdown display structures in an effort to improve portability. For example a knockdown display structure disclosed in U.S. Pat. No. 3,571,999 involves a set of upright tubes to which are fastened the ends of oval or rectangular spaced apart panels by loop and hook pressure engageable fasteners on the tubes and the ends of the spaced apart panels. While that structure is capable of dissassembly for improving transportability of its components, it does not lend itself to creation of a large unitary display surface comprises of a plurality of panel sections, nor does it lend itself to providing the degree of compactness in dissassembled form for convenient hand portability.

A somewhat similar structure appears in U.S. Pat. No. 4,001,987 and likewise has upright tubular members, but has the structural difference of having the spaced apart panels fastened to the tubular members by mechanical clips made of a plastic material and is unsuitable for modular formation of a large display surface from a plurality of panel sections.

A further portable display structure appears in U.S. Pat. No. 4,030,219 which involves a skeletal frame with upright channel members with panels carried in the frame structure by insertion of the ends of the panels in the respective channels and is a structure which is not suitable to forming a large single plane display surface composed of a plurality of panel sections.

SUMMARY OF THE INVENTION

The present invention makes possible the creation of substantially any reasonable size of unitary display surface as a modular structure from a plurality of panel sections and lends itself to being readily dissassembled to the form of a hand portable package which is sufficiently small and light in weight to accompany an individual on commercial air lines to any selected destination where it may be rapidly reassembled into a single plane display structure carrying a desired promotional message.

A primary object of the present invention is the provision of a modular single plane display surface structure which lends itself to rapid dissassembly into a highly compact hand portable package form and subsequent reassembly at the destination of use.

Another object is the provision of a modular single plane display surface structure which is sufficiently rugged to withstand the rigors of normal convention display use and and repetitive assembly and dissassembly.

And a further object is the provision of a modular single plane display surface structure wherein the seams formed by abutting panel sections are substantially invisible and thereby do not detract from the promotional or other material carried on the plane display surface of the structure.

These objects, features and advantages of the present invention are achieved generally by the provision of at least four panel sections arranged with their edges abutting edges of adjacent panel sections in manner that their front faces form a single plane display surface, a support panel on a portion of the back face of each of the associated panel sections and overlapping the abutting edges of such portions, manually separable pressure engageable loop and hook fastener elements fixed to the panel sections at support positions on the back face of each of the associated panel sections and to corresponding positions on the support panel for fastening the support panel and associated panel sections firmly together with capacity for dissassembly, and a removable periphery support member at each of the abutting edges at the periphery of the single plane display surface.

By making the periphery support members overlap the peripheral abutting edges on both the front and back faces of the associated panel sections, a desirably high degree of structural strength and rigidity of the plane surface display structure is thereby achieved.

By making the peripheral support members with a cross sectional configuration in the form of a J with two substantially parallel legs of different length and the longer leg being on the back face of the associated panel sections and the shorter leg overlapping a small portion of the front faces of the associated panel sections thereby maximizes the support to the overall structure and minimizes visual obstruction of the front face plane display surface.

By adding hanger elements fastened to the back faces of selected panel sections with manually separable pressure engageable loop and hook fasteners, a convenient arrangement for hanging the unitary modular display surface structure at suitable promotional locations is thereby acheived as well as capacity for easy removal of the hanger elements for permitting maximum compactness of packaging of the dissassembled structure and protection of panel sections from injury.

By making the support panel and the panel sections all of the same length and width when the number of panel sections is four, increased protection from injury of individual panels when in transportable package form is thereby achieved.

By making the support panels one half the length dimension and the same width dimension as the length and width dimension of the panel sections when the number of panel sections is an even number greater than four, increased compactness and resistance to injury of the panels when in disassembled transportation package form of the structure is thereby achieved.

By making the panel sections and support panels with a core of plastic foam material such as FOME-COR, a desirably light weight structure which enhances portability is thereby achieved, as well as a sufficiently rugged structure for withstanding normal promotional display use conditions.

These and other features, objects and advantages of the invention will be better understood from the following description taken in connection with the accompanying drawings.

BRIEF DESCRIPTION OF THE DRAWINGS

FIG. 1 is a plan view of a four panel sections modular single plane display surface structure in accordance with the present invention;

FIG. 2 is a side view of the FIG. 1 embodiment;

FIG. 3 is a rear view of the FIG. 1 embodiment;

FIG. 4 is a front view of a second embodiment of a modular single plane display surface structure in accordance with the present invention and comprised of eighteen panel sections;

FIG. 5 is a rear view of the FIG. 4 embodiment;

FIG. 6 is a view of the fastener face of a support panel for use in the FIG. 5 illustration;

FIG. 7 is a cross sectional view taken on line 7—7 of FIG. 5;

FIG. 8 is a front view of a suitable hand portable package arrangement for carrying the disassembled panels of the FIG. 4 embodiment and drawn to the same scale as FIG. 4 to show the extreme compactness achievable by the present invention; and FIG. 9 is a cross sectional view taken on line 9—9 of FIG. 8.

DETAILED DESCRIPTION OF THE PREFERRED EMBODIMENTS

Referring to the drawings in more detail, a preferred embodiment of a modular single plane display surface structure in accordance with the present invention is designated generally in FIGS. 1, 2 and 3 by the numeral 10. The modular display surface structure 10 includes four rectangular panel sections 12, 14, 16 and 18, all preferably having the same length, width and thickness dimensions and composed of a material having a core of a plastic foam which is very light in weight such as that known commercially as FOME-COR which is available from Monsanto Company, St. Louis, Mo.

The panel sections 12 and 14 have abutting edges 20, panel sections 16 and 18 have abutting edges 22, panel sections 12 and 16 have abutting edges 24, and panel sections 14 and 18 have abutting edges 26. The abutting edges 20, 22, 24 and 26 have a common juncture 28 at the center of the single plane display structure 10. A support panel 30, preferably of the same material and having the same length, width and thickness dimensions as the panel sections 12, 14, 16 and 18 is firmly fastened at support positions about the center 28 and the periphery of support panel 30 to the back faces of the respective panel sections 12, 14, 16 and 18 by manually separable pressure engageable loop and hook fastener strips 32 such as Scotchmate Fasteners which are available commercially from Minnesota Mining and Manufacturing Company, St. Paul, Minn. and which will be hereinafter more fully described in connection with FIGS. 5 and 6. The placement of the support panel 30 is preferably centrally of the structure 10 with its center coinciding with the center 28 so that it overlaps equal portions of the back faces of the respective panel sections 12, 14, 16 and 18 and the abutting edges 20, 22, 24 and 26.

Periphery support members 34 are also provided at the periphery of the structure 10 in overlapping relation to the peripheral end of each of the respective abutting edges 20, 22, 24 and 26 and associated panel sections. The periphery support members 34 are preferably of a thin transparent plastic material such as the acrylic. Plexiglas, or polycarbonate and have a J shaped cross sectional configuration with two substantially parallel legs of different length with the longer leg of each of the periphery support members 34 being fastened to the back faces of adjoining panel sections by manually separable and pressure engageable loop and hook fastener strips 36 as shown in FIG. 3 and with the shorter leg overlapping a small portion of the front faces of the abutting panel sections as shown in FIGS. 1 and 2. Thereby the panel sections 12, 14, 16 and 18 are held firmly together as a unitary structure 10 so that their front faces shown in FIG. 1 provide a single plane surface for receiving pictorial or verbal renditions or both (not shown) either directly on the single plane display surface shown in FIG. 1 or on a suitable sheet material such as paper or cloth which is glued or otherwise suitably fixed to the single plane display surface. In some instances to insure the substantial invisibility of the seams of the abutting edges 20, 22, 24 and 26, the display material is applied to a single large panel which is at least as large as the combined panel sections 12, 14, 16 and 18. Thereafter the large panel is cut with a sharp thin blade such as a razor blade into the four panel sections 12, 14, 16 and 18. It should be noted here that one of the desirable features of a material with a core of plastic foam such as FOME-COR is that it lends itself to relatively easy cutting into the individual panel sections described above.

It has been found that FOME-COR panel sections having a length of about 24 inches, a width of about 20 inches and a thickness of about $\frac{1}{4}$ inch, when combined with about $1\times3$ inch loop and hook strips 32 and 36 to form the present single plane display structure 10 result in adequate strength and rigidity and ruggedness to withstand the rigors of normal repetitive use in sales promotion assembly for display and subsequent dissassembly and transportation. Also the resulting $3\frac{1}{4}\times4$ foot single plane display surface is found to be of sufficient size for carrying an adequately large pictorial depiction of a product for effective sales promotion, as well as a conveniently small individual panel sections size for forming a convenient light weight dissassembled component package for hand carrying to a selected destination.

However, in those instances where larger display areas are desired, the present invention is well suited for effecting such larger single plane surface structure. Such an increased area modular single plane display surface structure in accordance with the present invention is illustrated in FIGS. 4 and 5 which show a second embodiment designated generally by the numeral 38. The modular single plane display surface structure 38 in FIGS. 4 and 5 is shown in smaller scale than the embodiment of FIGS. 1, 2 and 3 and includes 18 panel sections 40, 42, 44, 46, 48, 50, 52, 54, 56, 58, 60, 62, 64, 66, 68, 70, 72 and 74, all preferably having the same length dimension 76, width dimension 78 and thickness dimension 80 (FIG. 7) and composed preferably of a light weight plastic foam material such as the material used in the panel sections of the FIG. 1 embodiment.

Each group of four abutting panel section of FIGS. 4 and 5, such as panel sections 40, 42, 52 and 54, have abutting edges, such as 82, 84, 86 and 88 and a common juncture 90. A support panel 92, preferably of the same material as that of the panel sections and preferably having a length equal to the width 78 of the panel sections and a width which is $\frac{1}{2}$ the length 76 of the panel sections, is firmly fastened at suitable support positions, such as described below with respect to FIG. 6, about the center 90 and the periphery of the support panel 92 to the back faces of and centrally of the respective four associated panel sections 40, 42, 52 and 54 by manually separable pressure engageable loop and hook fastener strips such as the Scotchmate Fasteners referred to above with respect to the FIG. 1 embodiment. Similar support panels 94, 96, 98, 100, 102, 104, 106, 108 and 110 are fastened substantially centrally of each of the other groups of four abutting panel sections in the same manner as the support panel 92. As a representative example for all of the support panels, the fastener face of the support panel 110 is shown in FIG. 6 to illustrate suitable support position placement of the loop or hook elements 112 of the manually separable and pressure engageable fastener strips about the center and peripheral edges of the support panel 110, and the corresponding placements of the loop or hook mates 114 of the fastener strips on the associated group of four abutting panel sections 48, 50, 60 and 62. Both the loop and the hook elements 112 and 114 being preferably Scotchmate Fastener elements which have self stick cement back sides which provide a sufficiently firm permanent adhesion to the surfaces of the panel sections and support panels to withstand repetitive pressure engagement and tensile pull for separation of the loop and hook elements. Thus the respective support panels such as 110 and associated panel sections to which the loop and hook elements 112 and 114 are cemented may be firmly fastened together by pressing them together and subsequently as the need arises.

Also to facilitate placement on the respective panel sections the associated support panel such as 110, suitable marking on the back faces of the abutting panel sections such as shown by broken lines 116 may be made.

Periphery support members 118 are also provided at the periphery of the structure 38 in overlapping relation to the peripheral end of each of the seams of the abutting edges such as 82. The periphery support members 118 are preferably with a J shaped cross sectional configuration like that of the periphery support members 34 and in the FIG. 1 embodiment and similarly include separable pressure engageable loop and hook fastener strips 120 for fastening the longer leg of each of the periphery support members 118 to the back faces of each pair of associated abutting panel sections.

Hanger members 122 and 124 which may be of molded plastic or other suitable material may be fastened to the back faces of selected panel sections such as 66 and 72 respectively by manually separable pressure engageable loop and hook fastener elements 126 (FIG. 7) such as Scotchmate Fasteners. The hanger members 122 and 124 being below the peripheral edge of the structure 38 are each provided with an opening 128 in an offset bend portion for receiving a hanger hook or nail or other suitable hanger means (not shown).

It has been found that FOME-COR panel sections having a length 76 of about 30 inches and a width 78 of about 20 inches and a thickness 80 (FIG. 7) of about $\frac{1}{4}$ inch, when combined with about 178 $\times$3 inch loop and hook strips such as 112 and 114 form the present modular single plane display structure 38 with adequate strength and rigidity to withstand the rigors of repetitive use in sales promotion assembly and disassembly and transportation. The resulting $7\frac{1}{2}\times10$ foot single plane display surface of the FIG. 4 structure is sufficiently large to form a complete wall for an average display booth in a typical product promotion convention. Pictorial or other types of renditions may be applied to the display surface shown in FIG. 4 in manner similar to that described above in connection with the FIG. 1 embodiment.

In the operation of the modular single plane display surface structure 38 after a promotional display use, the structure 38 may be disassembled manually by pulling the 10 support panels such as support panel 110 away from the associated abutting panel sections which continue to retain their respective loop and hook elements 112 and 114 as appears in FIGS. 5 and 6. Periphery support members 118 are also similarly pulled away manually from the associated pairs of panel sections and removed from the structure, as are also the hanger members 122 and 124. All of the 18 panel sections such as panel section 50 may then be stacked one upon the other in a suitable receptacle 129 as shown in FIG. 9 and the 10 support panels such as support panel 110 being $\frac{1}{2}$ the length size of the panel sections are stacked side by side in pairs on the panel sections in the same receptacle 128. A suitable cover 130 and handle 132 and straps 134 combine to form a relatively simple and compact hand portable package for easy transportation of the disassembled structure.

It will be noted that the support panels such as 110 being $\frac{1}{2}$ the size of the panel sections such as 50, and the support panel 30 being the same size as the panel sections such as 16, thereby permit packaging which minimizes injury to peripheral edges of the panel sections or support panels because there are no resulting peripheral protrusions in the package. Also with FOME-COR $20\times30\times\frac{1}{4}$ inch panel sections and $15\times20\times\frac{1}{4}$ inch support panels, the entire structure 38 is found to weight only 17 pounds!

What is claimed is:

1. In a modular single plane display surface structure the combination of a. at least four panel sections with each panel section having only single plane surface side edges and with each panel section having only a single plane front and only a single plane back face and the single plane surface edges abutting the single plane surface edges of adjacent panel sections in manner such that the front of said panel sections form said single plane display surface about a common juncture of respective four panel sections, b. a plane surface support panel on a portion of the back face of each of said respective four panel sections about the associated common juncture and overlapping portions of said abutting edges, c. loop and hook fastener elements fixed to said panel sections at support positions about said associated juncture on the back face of each of the respective four panel sections and to corresponding positions on the plane surface of said support panel for fastening said support panel and respective four panel sections firmly together with capacity for dissassembly, and d. removable periphery support means at each of the abutting edges at the periphery of said single plane display surface, comprising a periphery support member overlapping each of said abutting edges on both the front and back faces of said panel sections whereby the support members and panel sections are firmly held together with capacity for disassembly.

2. The combination as in claim 1 wherein loop and hook fastener elements are fixed to corresponding support positions on the back faces of said panel sections and on the associated periphery support members in manner to hold the respective periphery support members and panel sections firmly together with capacity for disassembly.

3. The combination as in claim 2 wherein each of said periphery support members has a substantially J shaped cross sectional configuration with two substantially parallel legs of different length and the longer leg is on the back faces of the associated panel sections and the shorter leg overlaps a small portion of the front faces of said associated panel sections.

4. The combination as in claim 3 having additionally hanger members and loop and hook fastener elements fixed to the hanger members and back faces of selected panel sections for firmly fastening said hanger members to said selected panel sections with capacity for disassembly for said hanger members from said panel sections.

5. The combination as in claim 1 wherein the number of panel sections is four and said support panel means is comprised of a single support panel and said panel sections and support panel are all of substantially the same length and width dimensions.

6. The combination as in claim 5 wherein said panel sections and support panel are all of the same material.

7. The combination as in claim 6 wherein the said panel material is FOME-COR.

8. The combination as in claim 1 wherein the number of panel sections is greater than four and said support panel means is comprised of a support panel for each group of four panel sections having edges abutting each other, all of said panel sections being of substantially the same length and width dimensions and said support panels having one half the length dimension and the same width dimension as said panel sections.

* * * * *